US008798898B2

(12) United States Patent
Castillo-Effen et al.

(10) Patent No.: US 8,798,898 B2
(45) Date of Patent: Aug. 5, 2014

(54) METHODS AND SYSTEMS FOR INFERRING AIRCRAFT PARAMETERS

(75) Inventors: Mauricio Castillo-Effen, Rexford, NY (US); David So Keung Chan, Niskayuna, NY (US); Harold Woodruff Tomlinson, Jr., Ballston Spa, NY (US); Joel Kenneth Klooster, Grand Rapids, MI (US); Sergio Torres, Bethesda, MD (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 13/285,259

(22) Filed: Oct. 31, 2011

(65) Prior Publication Data

US 2013/0110387 A1 May 2, 2013

(51) Int. Cl.
*G08G 5/00* (2006.01)

(52) U.S. Cl.
CPC ..... *G08G 5/0095* (2013.01)
USPC ..... 701/120; 701/467

(58) Field of Classification Search
USPC ..... 701/120, 467, 528
See application file for complete search history.

(56) References Cited

U.S. PATENT DOCUMENTS

| | | | | |
|---|---|---|---|---|
| 4,792,906 | A * | 12/1988 | King et al. | 701/5 |
| 5,070,458 | A * | 12/1991 | Gilmore et al. | 701/14 |
| 6,873,903 | B2 | 3/2005 | Baiada et al. | |
| 7,248,949 | B2 | 7/2007 | Love et al. | |
| 7,398,182 | B2 | 7/2008 | Petit | |
| 7,457,690 | B2 | 11/2008 | Wilson et al. | |
| 7,584,073 | B2 * | 9/2009 | Coulmeau | 702/173 |
| 7,788,027 | B2 | 8/2010 | Jones | |
| 8,606,491 | B2 * | 12/2013 | Subbu et al. | 701/120 |
| 2005/0007272 | A1 | 1/2005 | Smith et al. | |
| 2006/0224318 | A1 | 10/2006 | Wilson et al. | |
| 2009/0132107 | A1 * | 5/2009 | DeJonge | 701/15 |
| 2010/0049382 | A1 | 2/2010 | Akalinli et al. | |
| 2010/0174475 | A1 * | 7/2010 | Estkowski et al. | 701/120 |
| 2011/0208374 | A1 * | 8/2011 | Jayathirtha et al. | 701/5 |

(Continued)

FOREIGN PATENT DOCUMENTS

| | | |
|---|---|---|
| EP | 1612140 A1 | 1/2006 |
| GB | 2404468 | 2/2005 |
| WO | 2009042405 | 4/2009 |

OTHER PUBLICATIONS

Coppenbarger, Richard A., "Climb trajectory prediction enhancement using airline flight-planning information", AIAA Guidance, Navigation, and Control Conference, Paper AIAA-99/4147, Aug. 9-11, 1999, 11 pages.*

(Continued)

*Primary Examiner* — Behrang Badii
*Assistant Examiner* — David Testardi
(74) *Attorney, Agent, or Firm* — John P. Darling

(57) ABSTRACT

A method and system suitable for inferring trajectory predictor parameters of aircraft for the purpose of predicting aircraft trajectories. The method and system involve receiving trajectory prediction information regarding an aircraft, and then using this information to infer (extract) trajectory predictor parameters of the aircraft that are otherwise unknown to a ground automation system. The trajectory predictor parameters can then be applied to one or more trajectory predictors of the ground automation system to predict a trajectory of the aircraft. In certain embodiments, the method and system can utilize available air-ground communication link capabilities, which may include data link capabilities available as part of trajectory-based operations (TBO).

7 Claims, 3 Drawing Sheets

Effect of Climb Mode and Takeoff Weight on Top of Climb Distance

(56) References Cited

U.S. PATENT DOCUMENTS

| | | | | |
|---|---|---|---|---|
| 2012/0053916 | A1* | 3/2012 | Tzidon | 703/8 |
| 2012/0215434 | A1* | 8/2012 | Subbu et al. | 701/120 |
| 2012/0215435 | A1* | 8/2012 | Subbu et al. | 701/120 |
| 2012/0245834 | A1* | 9/2012 | Klooster et al. | 701/120 |
| 2012/0265374 | A1* | 10/2012 | Yochum | 701/5 |

OTHER PUBLICATIONS

Godbole, Amit A., Masters thesis, "Adaptive Improvement of Climb Performance", University of Cincinnati, Aug. 15, 2003, 112 pages.*
Gong, Chester et al., "Using flight manual data to derive aero-propulsive models for predicting aircraft trajectories", AIAA, Paper AIAA-2002-5844, 2002, 7 pages.*
Konyak, Michael A. et al., "Improving ground based trajectory prediction through communication of aircraft intent", AIAA Guidance, Navigation, and Control Conference, Paper AIAA-2009-6080, Aug. 10-13, 2009, 25 pages.*
Oaks, Robert D. et al., "Prototype implementation and concept validation of a 4-d trajectory fuel burn model application", AIAA, Paper AIAA-2010-8164, 2010, 17 pages.*
Schultz, Charles A. et al., "Adaptive trajectory prediction for climbing flights," AIAA, Paper AIAA-2012-4931, 16 pages.*
Suchkov, Alexander et al., "Aircraft performance modeling for air traffic management applications", 5th USA/Europe Air Traffic Management Research and Development Seminar, Budapest, Hungary, Jun. 23-27, 2003, 10 pages.*
Warren, Anthony W. et al., "Vertical path trajectory prediction for next generation ATM", Proceedings of the 17th AIAA/IEEE/SAE DASC, Digital Avionics Systems Conference, Oct. 31-Nov. 7, 1998, vol. 2, pp. F11/1-F11/8.*
Web page, "AWARDS: 2011 Region III AIAA Student Conference", downloaded from http://www.aviationsystemsdivision.arc.nasa.gov/about/awards/2011_aiaa_student_conf.shtml.*
Schultz, Charles A. et al., "Adaptive trajectory prediction for climbing flights," AIAA, Paper AIAA-2012-4931, 2012, 16 pages.*
Lecchini, A. et al. "Monte carlo optimization strategies for air traffic control", 2005 AIAA Guidance, Navigation, and Control Conferences, pp. 1-8, downloaded from http://citeseerx.ist.psu.edu/viewdoc/download?doi=10.1.1.104.3628&rep=rep1&type=pdf.*
Kochenderfer, Mykel et al., "A bayesian approach to aircraft encounter modeling", AIAA Guidance, Navigation and Control Conference and Exhibit, Aug. 18-21, 2008, Paper AIAA 2008-6629, 21 pages.*
Wikipedia page, "Probability density function", old version dated Oct. 27, 2010, downloaded from http://en.wikipedia.org/w/index.php?title=Probability_density_function&oldid=393310452.*
Eurocontrol, ADAPT2 Aircraft Data Aiming at Predicting the Trajectory, Data analysis Report, Issued Dec. 2009.
Search Report and Written Opinion from corresponding EP Application No. 12190580.6-1810 dated Feb. 11, 2013.
Tamvaclis et al., "Use of aircraft derived data for more efficient ATM operations", Digital Avionics Systems Conference, 2004. DASC 04. The 23rd Salt Lake City, UT, USA Oct. 24-28, 2004, Piscataway, NJ, USA, IEEE, US, vol. 1, pp. 3.B.4-1-3.B.4-12, Oct. 24, 2004.

* cited by examiner

Effect of Climb Mode and Takeoff Weight on Top of Climb Distance

METHODS AND SYSTEMS FOR INFERRING AIRCRAFT PARAMETERS

BACKGROUND OF THE INVENTION

The present invention generally relates to methods and systems for managing air traffic. More particularly, aspects of this invention include methods and systems for predicting trajectories of aircraft using models that may be adapted via tunable parameters. Those parameters may have direct physical meaning (for example, weight) or they may be abstract, as in the case of the ratio of two physical variables such as the ratio of thrust to mass. Accurate trajectory prediction is key to a number of air traffic control and trajectory management applications, and the ability to infer parameters helps to improve the level of prediction accuracy. The trajectory prediction methods and systems are preferably capable of making use of automation systems of the Air Navigation System Provider (ANSP) or of the Operations Control Center (OCC).

Trajectory-Based Operations (TBO) is a key component of both the US Next Generation Air Transport System (NextGen) and Europe's Single European Sky ATM Research (SESAR). There is a significant amount of effort underway in both programs to advance this concept. Aircraft trajectory synchronization and trajectory negotiation are key capabilities in existing TBO concepts, and provide the framework to improve the efficiency of airspace operations. Trajectory synchronization and negotiation implemented in TBO also enable airspace users (including flight operators (airlines), flight dispatchers, flight deck personnel, Unmanned Aerial Systems, and military users) to regularly fly trajectories close to their preferred (user-preferred) trajectories, enabling business objectives, including fuel and time savings, wind-optimal routing, and direction to go around weather cells, to be incorporated into TBO concepts. As such, there is a desire to generate technologies that support trajectory synchronization and negotiation, which in turn are able to facilitate and accelerate the adoption of TBO.

As used herein, the trajectory of an aircraft is a time-ordered sequence of three-dimensional positions an aircraft follows from takeoff to landing, and can be described mathematically by a time-ordered set of trajectory vectors. In contrast, the flight plan of an aircraft will be referred to as information—either physical documents or electronic—that is filed by a pilot or a flight dispatcher with the local civil aviation authority prior to departure, and include such information as departure and arrival points, estimated time en route, and other general information that can be used by air traffic control (ATC) to provide tracking and routing services. Included in the concept of flight trajectory is that there is a trajectory path having a centerline, and position and time uncertainties surrounding this centerline. Trajectory synchronization may be defined as a process of resolving discrepancies between different representations of an aircraft's trajectory, such that any remaining differences are operationally insignificant. What constitutes an operationally insignificant difference depends on the intended use of the trajectory. Relatively larger differences may be acceptable for strategic demand estimates, whereas the differences must be much smaller for use in tactical separation management.

An overarching goal of TBO is to reduce the uncertainty associated with an aircraft's future location through use of an accurate four-dimensional trajectory (4DT) in space (latitude, longitude, altitude) and time. The use of precise 4DTs resulting from improved trajectory predictions has the ability to dramatically reduce the uncertainty of an aircraft's future flight path, including the ability to predict arrival times at a geographic location (referred to as metering fix, arrival fix, or cornerpost) for a group of aircraft that are approaching their arrival airport. Such a capability represents a significant change from the present "clearance-based control" approach (which depends on observations of an aircraft's current state) to a trajectory-based control approach, with the goal of allowing an aircraft to fly along a user-preferred trajectory. Thus, a critical enabler for TBO is not only the availability of an accurate, planned trajectory (or possibly multiple trajectories) and providing ATC with valuable information to allow more effective use of airspace, but also more accurate trajectory predictors that, if used in conjunction with appropriate Decision Support Tools (DSTs), would allow ATC to trial-plan different alternative solutions to address requests filed by airspace users while meeting ATC constraints. Another enabler of TBO is the ability to exchange data between aircrafts and ground. Several air-ground communication protocols and avionics performance standards exist or are under development, for example, controller pilot data link communication (CPDLC) and automatic dependent surveillance-contract (ADSC) technologies.

There exist a number of trajectory modeling and trajectory prediction frameworks and tools that have been proposed and that are currently in use in automation systems in air and on the ground, for instance, those described in WO 2009/042405 A2 entitled "Predicting Aircraft Trajectory," U.S. Pat. No. 7,248,949 entitled "System and Method for Stochastic Aircraft Flight-Path Modeling," and U.S. 2006/0224318 A1 entitled "Trajectory Prediction." However, these trajectory modeling and trajectory prediction methods and systems do not disclose any capabilities for deriving or inferring parameters that are not available or known in explicit form, yet would be needed by trajectory predictors to achieve a higher degree of prediction accuracy. Improved prediction accuracies require better knowledge of the performance characteristics of an aircraft. However, in some cases, performance information cannot be shared directly with ground automation because of concerns related to information that is considered strategic and proprietary to the operator. Two typical examples of this category are aircraft weight and cost index. In other cases, the bandwidth of air-ground communication systems used to communicate relevant performance parameters is often constrained.

Other significant gaps remain in implementing TBO, due in part to the lack of validation activities and benefits assessments. In response, the General Electric Company and the Lockheed Martin Corporation have created a Joint Strategic Research Initiative (JSRI), which aims to generate technologies intended to accelerate the adoption of TBO in the Air Traffic Management (ATM) realm. Efforts of the JSRI have included the use of GE's Flight Management System (FMS) and aircraft expertise and the use of Lockheed Martin's ATC domain expertise, including the En Route Automation Modernization (ERAM) and the Common Automated Radar Terminal System (Common ARTS), to explore and evaluate trajectory negotiation and synchronization concepts. Ground automation systems typically provide trajectory predictors capable of predicting the paths of aircraft in time and space, providing information that is required for planning and performing critical air traffic control and traffic flow management functions, such as scheduling, conflict prediction, separation management and conformance monitoring. On board an aircraft, the FMS can use a trajectory for closed-loop guidance by way of the automatic flight control system (AFCS) of the aircraft. Many modern FMSs are also capable of meeting a required time-of-arrival (RTA), which may be assigned to an aircraft by ground systems.

Notwithstanding the above technological capabilities, questions remain related to Trajectory-Based Operations, including the manner in which parameters needed by trajectory predictors may be obtained from available information, for instance, from downlinked information, to guarantee an efficient air traffic control process where users meet their business objectives while fully honoring all ATC objectives (safe separation, traffic flow, etc.). In particular, there is a need for enabling ground automation systems to increase their prediction accuracy by having the ability to obtain key parameters used by the trajectory predictor, for instance, those related to an aircraft's performance. However, aircraft and engine manufacturers consider detailed aircraft performance data proprietary and commercially sensitive, which may limit the availability of detailed and accurate aircraft performance data for ground automation systems. Moreover, the aircraft thrust, drag, and fuel flow characteristics can vary significantly based on the age of the aircraft and time since maintenance, which ground automation systems will likely not know or be able to explicitly obtain. In some cases, aircraft performance information, such as gross weight and cost index, cannot be shared directly with ground automation because of concerns related to information that is considered strategic and proprietary to the operator. Even if these performance parameters were shared directly, because the aircraft performance model used by the aircraft and ground automation systems may be significantly different, they may actually decrease the accuracy of the ground trajectory prediction if used directly.

In addition to the above, the ability of ground automation systems to increase their prediction accuracy is further complicated by increasing levels of air traffic combined with the need to support more efficient airspace operations, the impact of potential revisions in the aircraft flight plan or airspace constraints, and constraints on bandwidth for communicating relevant performance parameters.

BRIEF DESCRIPTION OF THE INVENTION

The present invention provides a method and system that are suitable for inferring trajectory predictor parameters and, in some instances, capable of utilizing available air-ground communication link capabilities, which may include data link capabilities available as part of planned aviation system enhancements. This invention also considers current operations in which the utilization of voice communications is more prevalent. Methods and systems of this invention preferably enable ground automation systems to increase their prediction accuracy by inferring key parameters used by its trajectory prediction algorithms, even when the aircraft performance models used by the aircraft and ground trajectory predictors do not map directly.

According to a first aspect of the invention, the method includes receiving trajectory prediction information regarding an aircraft, and then using this information to infer (extract) trajectory predictor parameters of the aircraft that are otherwise unknown to a ground automation system. In preferred embodiments of the invention, the trajectory predictor parameters can then be applied to one or more trajectory predictors of the ground automation system to predict a trajectory of the aircraft.

According to a preferred aspect of the invention, parameter estimation techniques, such as Bayesian inference, may be applied to recursively improve prior information about the unknown trajectory predictor parameters. Trajectory predictor parameters of an aircraft can be estimated by comparing trajectory prediction information predicted for the aircraft (for example, from an accurate model normally available from an aircraft's onboard trajectory predictor) to a set of trajectory prediction information generated by another trajectory predictor. The set of trajectory prediction information can be generated by varying the parameter inputs to be estimated over likely values, after which the parameter estimates can be updated based upon the comparison. Hence, previous knowledge about the unknown trajectory predictor parameters, even though riddled with high uncertainty, may be used if these techniques are applied. Another preferred aspect of the invention involves the use of a probability density function (PSD) and an update process to estimate and refine the estimate of the trajectory predictor parameters of the aircraft.

Other aspects of the invention include systems adapted to carry out the methods and steps described above.

A technical effect of the invention is the ability to infer trajectory predictor parameters of an aircraft to significantly improve the accuracy of ground-based trajectory predictors. While the use of surveillance and measured data relating to the performance of an aircraft can be incorporated into the method described above for the purpose of predicting the aircraft's trajectory, the present invention does not solely rely on the use of surveillance and measured data, as has been the case with prior art systems and methods that attempt to predict aircraft trajectories. In any event, the ability to significantly improve the accuracy of ground-based trajectory predictors with this invention can then be translated into better planning capabilities, especially during the stages of flight which require better knowledge of those parameters, for instance while executing Continuous Descent Arrivals (CDAs). Other potential advantages enabled by the parameter inference process of this invention include reduced bandwidth utilization of air-ground communication systems and an improved capability for predicting costs associated with specific maneuvers, which may enable ATC systems to generate maneuver advisories with consideration of cost incurred by the aircraft.

Other aspects and advantages of this invention will be better appreciated from the following detailed description.

DETAILED DESCRIPTION OF THE INVENTION

The invention describes methods and systems for inferring aircraft performance parameters that are otherwise unknown to ground automation systems. The performance parameters are preferably derived from aircraft state data and trajectory intent information provided by the aircraft operator via a communication link, which may be voice and/or data. In particular, methods and systems of this invention may utilize data link capabilities if available, including those data link capabilities that may be available as part of planned aviation system enhancements. Methods and systems of this invention may also consider current operations where the utilization of voice communications is more prevalent, in which case useful information may include key trajectory change points commonly transmitted by pilots via voice, such as the location of the Top of Descent (ToD) point with respect to the metering fix or the location of the Top of Climb with respect to the wheels-off point. In addition, surveillance information may be used to improve the inference process. The inferred parameters are employed for modeling aircraft behavior using ground automation systems for such purposes as trajectory prediction, trial planning, and predicting aircraft operational costs.

As previously discussed, Air Traffic Management (ATM) techniques rely on the projection of an aircraft's state into the future in four dimensions—latitude, longitude, altitude and time (4DT). The 4DT of an aircraft may be used to detect potential problems with the aircraft's planned flight, such as a predicted loss of separation standards between multiple aircraft, and potential problems concerning the ability of assigned air traffic control resources to safely handle a large number of aircraft in a given airspace. When such problems are detected, the present invention can be employed to infer otherwise unknown aircraft performance parameters, from which one or more trial or "what if" trajectories can be predicted for an aircraft and used to evaluate the impact of potential modifications to the flight plan or trajectory, to determine whether those other 4DTs may be capable of alleviating the particular problem in a safe and efficient manner. The inferred aircraft performance parameters allow ground automation systems to improve the accuracy of the performance models of the aircraft beyond what is otherwise available and commonly used, which allows air traffic control to more accurately perform trajectory predictions and trial planning. Notably, predictor methods and systems with access to such performance models increase the accuracy of the predicted trajectory and allow the incorporation of aircraft operational cost considerations in the trial planning process.

Figure 1:
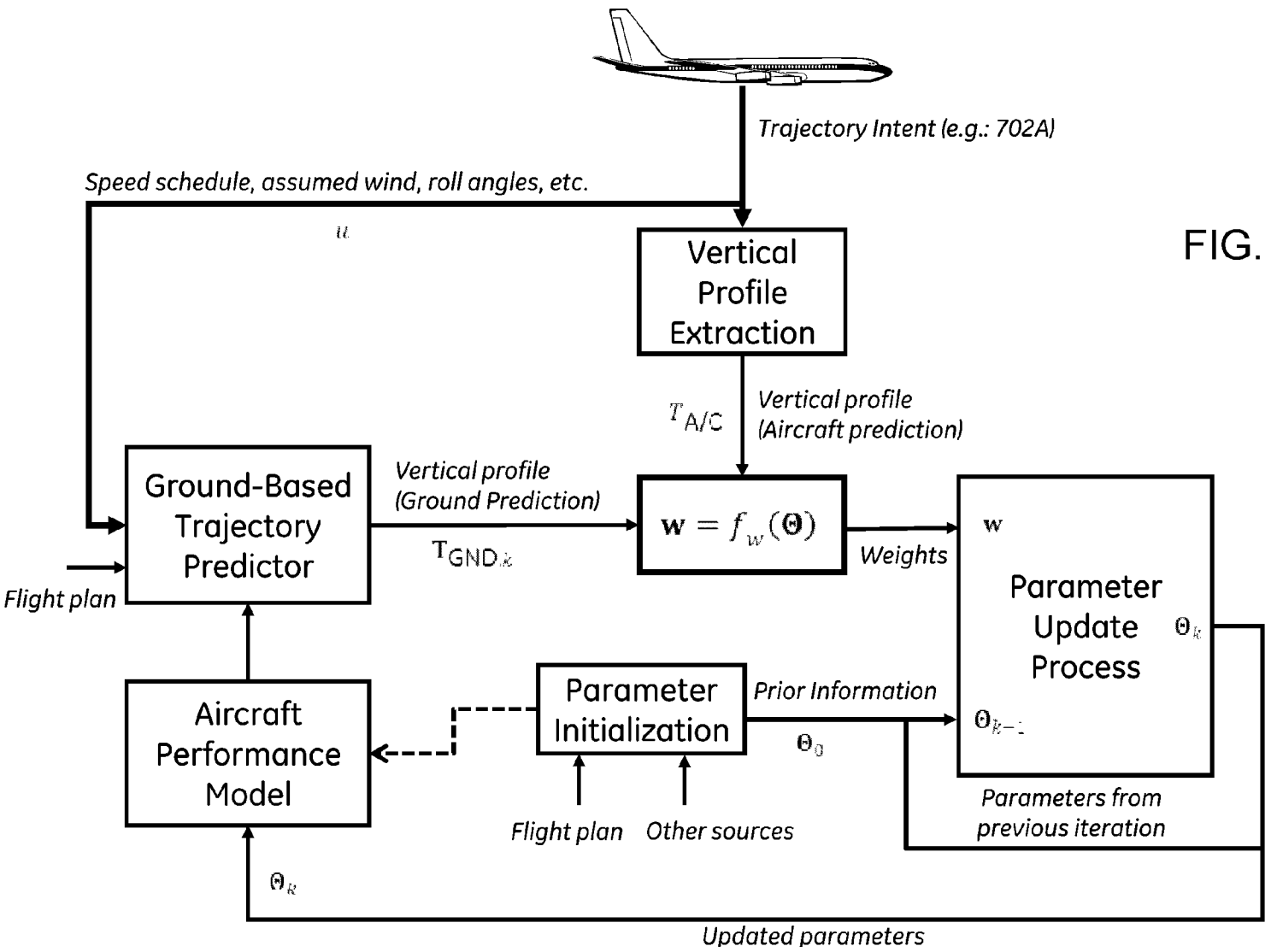
FIG. 1 is a block diagram of a parameter inference process for predicting four-dimensional trajectories of aircraft within an airspace in accordance with a preferred aspect of this invention.

FIG. 1 schematically represents a parameter inference process and system according to one aspect of the present invention. In this diagram, all blocks show functions that may be performed on a ground system. For example, they could reside at an air traffic control center or at an airline operations center. The ground system receives information from the aircraft related to the predicted trajectory. If this information comes directly from the aircraft, the information may be transmitted via a data transmission link, such as ADS-C (Automatic Dependence Surveillance Contract). The elements of the transmitted data may be obtained from the "Trajectory Intent Bus" of the Flight Management Computer (FMC), defined in the standard ARINC702A-3. It is also foreseeable that this information may originate at the airline operations center, in which case the information may be communicated to air traffic control via a ground-based network similar to those already in use for collaborative air traffic control purposes and for filing flight plans. Furthermore, information may also be transmitted via voice communications, in which case data may comprise some elements that define the aircraft trajectory, examples of which are: a Required Time of Arrival (RTA) at the metering fix keyed into the FMC, a trajectory change point (Top of Climb, Top of Descent, etc.) or parameters keyed into the Mode Control Panel. The information itself may be divided into two groups: 1) inputs to the trajectory prediction process (u), such as speed schedules, assumed winds, etc., and 2) outputs, more specifically the predicted vertical profile ($T_{A/C}$) or some of its elements. The vertical profile or some of its elements used in the parameter inference process are assumed to be constructed using detailed information about performance-related parameters that are often not known by the ground automation system and thus need to be inferred. The extraction of the vertical profile information is represented by a dedicated block in the diagram. Alternatively, this step may be performed by the aircraft, in which case the vertical profile would be provided directly to the ground automation system. The downlinked vertical profile may be represented by a set of n three-dimensional points, consisting of time, along-route distance and altitude.

$$T_{A/C}=\{x_{A/C,j}=(t_j,d_j,h_j);j=1\ldots n\}$$

The parameters that need to be inferred are initialized in a process represented by the block "Parameter Initialization." In the parameter inference process all parameters are represented by a probability density function (PDF), which could be of any nature (Gaussian, uniform, etc.). Furthermore, in one particular instantiation of the method presented in this invention, the PDF may be approximated by random samples, also known as "particles." Hence, parameters may be initialized as a particle ensemble $\Theta_0$, also referred to as "belief," according to:

$$\Theta_0=\{(\theta_0^i,w_0^i);i=1\ldots N_s\}$$

Each of the $N_s$ random samples constitutes a hypothesis as to what the parameters ($\theta_0^i$) of the system could be, associated with a weight proportional to their probability ($w_0^i$). For instance, for the parameter take-off mass m, depending on the type of aircraft, the aircraft mass can only have a specific range of values specified by the manufacturer, for example, between $m_{MIN}$ and $m_{MAX}$. If at the beginning of the process this range is the only information available to the parameter inference process, and if take-off mass was the only parameter to be inferred, the samples of the PDF would be distributed according to a uniform distribution spanning all the possible values within that range: $\theta_0 \sim U(m_{MIN}, m_{MAX})$. In this illustrative example, weights of the particles would be initialized with the value $1/N_s$ conforming to the uniform distribution. As shown in FIG. 1, other sources of information, such as the flight plan, may be also used to initialize the PDF associated with aircraft mass, assigning higher probability to values that would better match flight length and fuel reserve regulations. Statistical information collected over time could be also used to initiate the process. These parameters become part of the aircraft performance model that can be used by the ground-based trajectory predictor.

The trajectory predictor itself, which runs in fast-time mode, is used in the parameter inference process. First, it generates a set of trajectories $T_{GND,k}$ corresponding to all samples in the belief $\Theta_k$. $\Theta_k$ denotes the state of the estimation at the kth step of the inference process. The weighting function $w=f_w(\Theta)$ computes weights for each trajectory $T_{GND,k}^i$ in the ensemble $T_{GND,k}$. There are several alternatives for weight calculation, one of which involves assigning a probabilistic interpretation to the downlinked trajectory used as reference ($T_{A/C}$). The calculated weight is then proportional to the probability of trajectory points in $T_{GND,k}^i$ being in $T_{A/C}$. In one case, when single trajectory points are processed one at a time, the weight of each particle "i" may be calculated as:

$$w_k^i \propto P\{x_{GND,k}^i \in T_{A/C}\}$$

Alternatively, trajectory points may be calculated all at once. Hence, weights would be proportional to the total probability of all n trajectory points in $T_{GND,k}^i$ being in $T_{A/C}$:

$$w_k^i \propto \prod_{j=1}^{n} P\{x_{GND,j,k}^i \in T_{A/C}\}$$

One possibility for computing $P\{x_{GND,j,k}^{i} \epsilon T_{A/C}\}$ involves assuming a Gaussian spread around the trajectory $T_{A/C}$, defining: a distance metric $d(x_{GND,j,k}^{i}, T_{A/C})$ (distance from point $x_{GND,j,k}^{i}$ to trajectory $T_{A/C}$), and a measure of spread σ. Then:

$$w_k'^i = P\{x_{GND,j,k}^i \in T_{A/C}\} = \frac{1}{\sqrt{2\pi\sigma^2}} e^{\frac{[d(x_{GND,j,k}^i, T_{A/C})]^2}{2\sigma^2}}$$

Actual weights can be computed by normalizing $w'^{i}_{k}$ $$w_k^i = \frac{w_k'^i}{\sum_i^{N_S} w_k'^i}$$

To speed up computations alternative distributions such as the triangular distribution could be used to determine particle weights.

The next step in the parameter estimation process involves determining the updated parameter belief from previously calculated weights and belief. In the diagram, this step is shown as "Parameter Update Process." Following on the illustrative example using a particle representation of belief, this step may be performed applying importance resampling, which consists of generating a new set of particles $\Theta_k$ by drawing samples from the original set $\Theta_{k-1}$ with a probability proportional to their weight $w_k^i$. The process of constant refinement of the parameters to be estimated is continued as updated predictions are obtained from the aircraft, and/or as surveillance and measured data (measured track and state data) of the aircraft become available.

Figure 3:
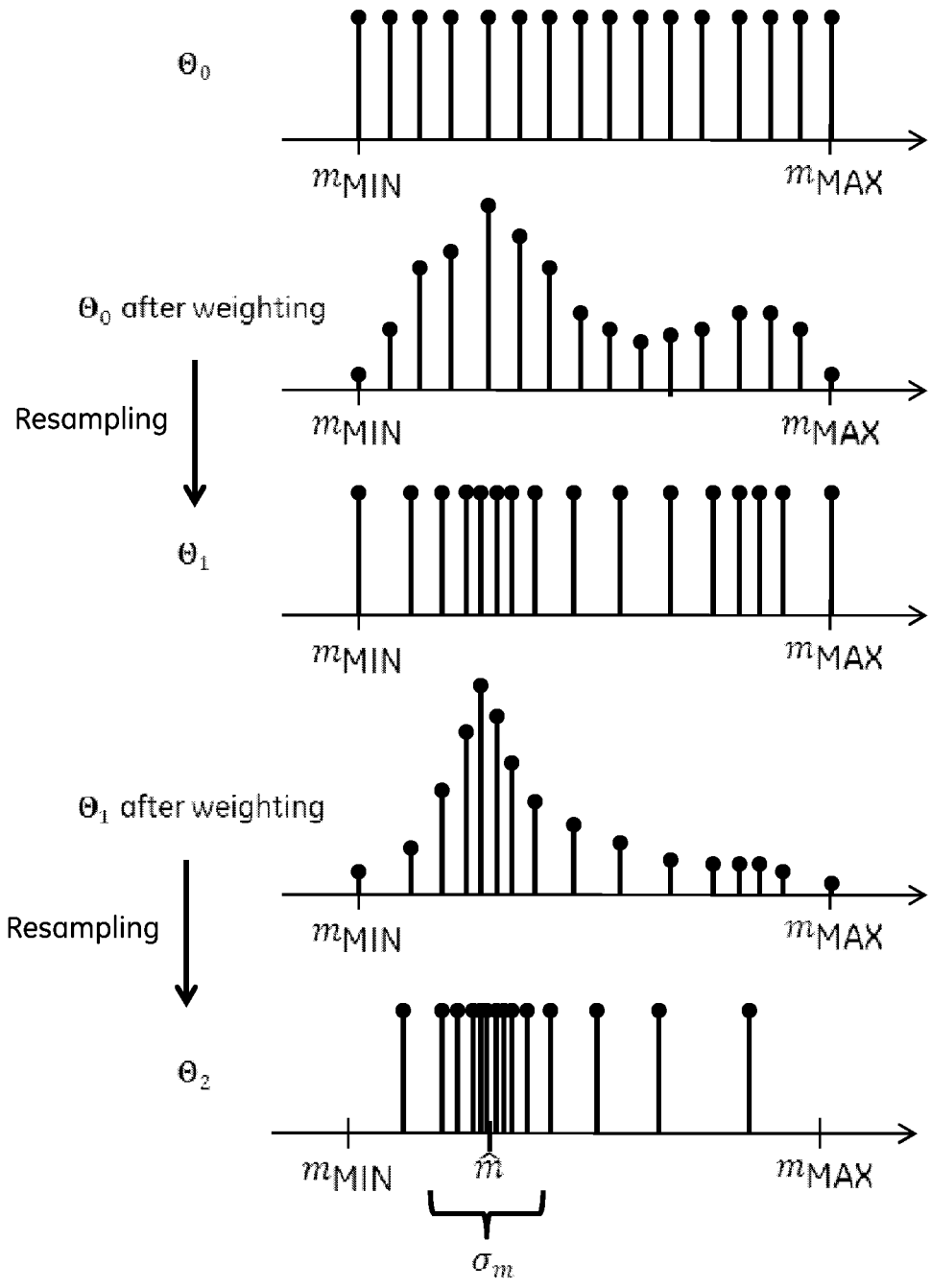
FIG. 3 qualitatively depicts a parameter update process that can be employed by the invention.

FIG. 3 depicts in a qualitative manner the parameter update process starting from a sampled uniform distribution and arriving at a unimodal distribution, from which the most likely estimate could be derived as well as a measure of confidence. Major steps of the parameter inference process such as weighting and resampling may be observed from this diagram.

It is important to note that parameters do not have to be unidimensional. The use of the take-off mass of the aircraft as the main parameter to be inferred is just for illustration. Extending the vector of parameters to be estimated to include takeoff mass and, for instance, cost index $k_{CI}$ is simple. Analogously, Monte Carlo sequential estimation can be used to illustrate the parameter inference process. Alternatively, another Bayesian estimation-type of technique that uses a different representation of belief could be applied, for example histograms, grids, or even parametric representations (e.g.: Gaussian) instead of particles, when appropriate.

The parameter inference process and system represented in FIG. 1 addresses issues arising from the fact that, in practice, many aircraft are unable to provide some or all of the data required to accurately predict their 4DT trajectories because the aircraft are not properly equipped or, for business-related reasons, flight operators have imposed restraints as to what information can be shared by the aircraft. Under such circumstances, the parameter inference process and system represented in FIG. 1 can be used by an ATC system to compute and infer some or all of the data relating to aircraft performance parameters required for accurate trajectory prediction. Because fuel-optimal speeds and in particular the predicted 4DT are dependent on data relating to aircraft performance parameters to which the ATC system does not have access (such as aircraft mass, engine rating, and engine life), certain data that can be provided by appropriately equipped aircraft are expected to be more accurate than data inferred or otherwise generated by the ATC system. Therefore, the parameter inference process and system is preferably adapted to take certain steps to enable the ATC system to more accurately infer data relating to aircraft performance characteristics that will assist the ATC system in predicting other aircraft performance data, including fuel-optimal speeds, predicted 4DT, and factors that influence them when this data is not provided from the aircraft itself. As explained below, the aircraft performance parameters of interest will be derived in part from aircraft state data and trajectory intent information typically included with data provided by the aircraft via a communication datalink or via voice. Optionally or in addition, surveillance information can also be used to improve the inference process. The inferred parameters are then used to model the behavior of the aircraft by the ATC system, specifically for trajectory prediction purposes, trial planning, and estimating operational costs associated with different trial plans or trajectory maneuvers.

In order to predict the trajectory of an aircraft, the ATC system must rely on a performance model of the aircraft that can be used to generate the current planned 4DT of the aircraft and/or various "what if" 4DTs representing unintentional changes in the flight plan for the aircraft. Such ground-based trajectory predictions are largely physics-based and utilize a model of the aircraft's performance, which includes various parameters and possibly associated uncertainties. Some parameters that are considered to be general to the type of aircraft under consideration may be obtained from manufacturers' specifications or from commercially available performance data. Other specific parameters that tend to be more variable may also be known, for example, they may be included in the filed flight plan or provided directly by the aircraft operator. However, other parameters are not provided directly and must be inferred by the ATC system from information obtained from the aircraft and optionally, from surveillance information. The manner in which these parameters can be inferred is discussed below.

Aircraft performance parameters such as engine thrust, aerodynamic drag, fuel flow, etc., are commonly used for trajectory prediction. Furthermore, these parameters are the primary influences on the vertical (altitude) profile and speed of an aircraft. Thus, performance parameter inference has the greatest relevance to the vertical portion of the 4DT of an aircraft. However, the aircraft thrust, drag, and fuel flow characteristics can vary significantly based on the age of the aircraft and time since maintenance, which the ATC system will not likely know. In some cases, airline performance information such as gross weight and cost index cannot be shared directly with ground automation because of concerns related to information that is considered strategic and proprietary to the operator.

Figure 2:
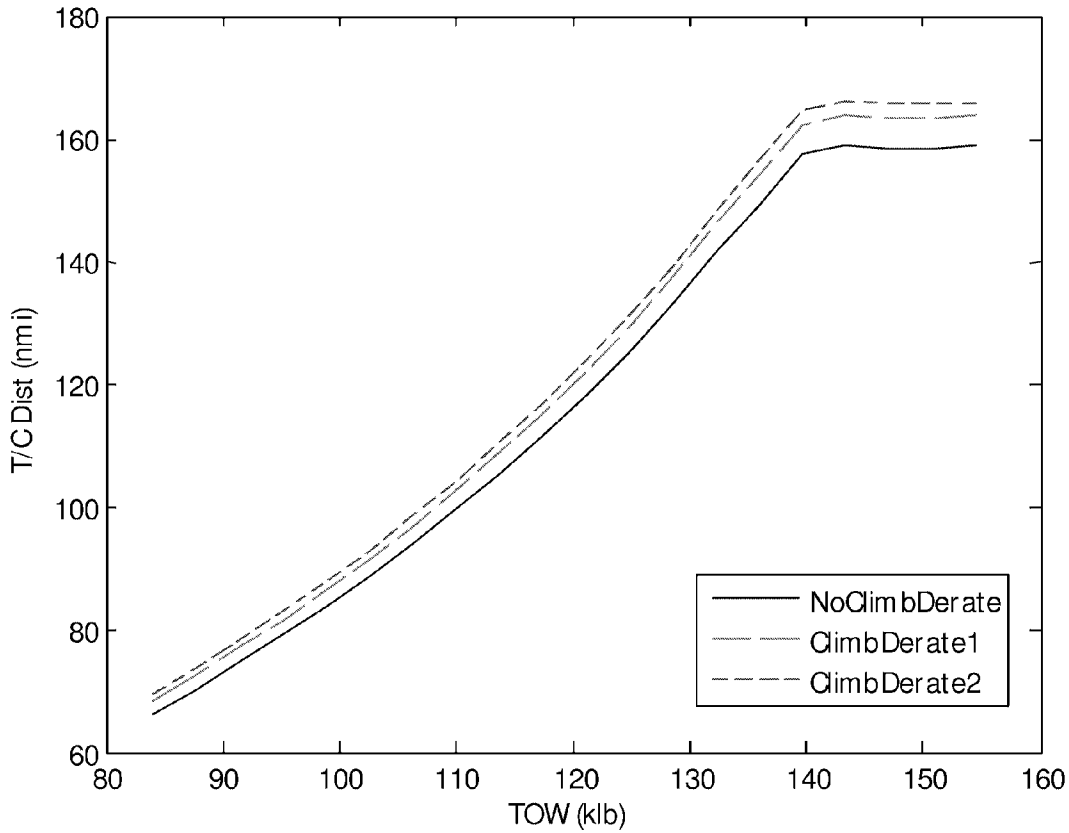
FIG. 2 is a graph containing three curves that evidence a dependency of the along-route distance of an aircraft corresponding to the aircraft's top of climb (T/C) point on the takeoff weight of an aircraft.

In view of the above, a parameter initialization process is required for the inference process of this invention. It has been determined that thrust during the climb phase of an aircraft may be assumed to be known within a certain range, with variations subject mainly to derated power settings. This uncertainty may be taken into account by actually defining a statistical model for thrust which considers three different derating settings. FIG. 2 plots three curves expressing the dependency of the along route distance (T/C Dist) corresponding to the top of climb (T/C) point as a function of takeoff weight (TWO). The calculations represented by FIG. 2 have been performed with a simulated Flight Management System (FMS). The curves represent three possibilities of specific climb modes: "Maximum Climb," "Climb Derate 1"

and Climb Derate 2," as specified in the information entered into an aircraft's FMS. As observed from FIG. 2, there is a direct dependency between the distance to top of climb and TOW up to a certain value of TOW. For a given T/C Dist prediction, and in case that the climb mode is not known, there is a range of possible TOW values. Uncertainty in the T/C Dist estimate also generates additional uncertainty in the TOW. For example, around the middle of the curve, uncertainty in T/C Dist of 5 nmi translates into an uncertainty of 6 klb in TOW, considering unknown climb mode. A weight range is also known from the aircraft manufacturer specifications, which may be further enhanced with knowledge originating from the filed flight plan and from applicable regulations (distance between airports, distance to alternate airport, minimum reserves, etc.).

Additional inputs to the prediction model but needed for the inference process, including aircraft speeds, assumed wind speeds and roll angles, can be derived from lateral profile information and used to predict a vertical profile for the aircraft. Such inputs can be downlinked from an aircraft, and can typically be obtained from information already available in modern flight management systems (ARINC 702A), for example, in the so-called intent bus. Downlinked information may be partitioned into two major pieces: inputs to the trajectory predictor; and predicted vertical profile.

In view of the above, the present invention is able to use knowledge of an aircraft's predicted trajectory during takeoff and climb to infer the takeoff weight (mass) of the aircraft. If an estimate of the aircraft's fuel flow is available, this can be used to predict the weight of the aircraft during its subsequent operation, including its approach to a metering fix. Subsequent surveillance and measured data, for example, track and state data including measurements of the aircraft state (such as speeds and rate of climb or descent) relative to the predicted trajectory can be used to refine the estimate of the fuel flow and predicted weight. The weight of the aircraft can then be used to infer additional data relating to aircraft performance parameters, such as the minimum fuel-cost speed and predicted trajectory parameters of the aircraft, since they are known to depend on the mass of the aircraft. As an example, the weight of the aircraft is inferred by correlating the takeoff weight of the aircraft to the distance to the top of climb that occurred during takeoff. A plurality of generation steps can then be used to predict a vertical profile of the aircraft during and following takeoff. Each generation step comprises comparing the predicted altitude of the aircraft obtained from one of the generation steps with a current altitude of the aircraft reported by the aircraft. The difference between the current and predicted altitudes is then used to generate a new set of inferred parameters based on prior information (in the first cycle) or based on previous inference results. When obtained from an aircraft, new information can be used to update the latest inferred parameters in a sequential process. The latest inferred parameters are then fed into the aircraft performance model used by the trajectory predictor.

While the invention has been described in terms of specific embodiments, it is apparent that other forms could be adopted by one skilled in the art. For example, the functions of components of the parameter inference system and process could be performed by different components capable of a similar (though not necessarily equivalent) function. Therefore, the scope of the invention is to be limited only by the following claims.

The invention claimed is:

1. A method of inferring aircraft performance parameters capable of being used by a trajectory predictor to predict trajectories of an aircraft, the method comprising:

receiving, by an air traffic control system, trajectory prediction information regarding an aircraft including at least one change point in a predicted vertical profile; and then using the trajectory prediction information to infer, in a parameter inference process performed by the air traffic control system, aircraft performance parameters of the aircraft that are otherwise unknown to a ground automation system, wherein parameter inference process uses a probability density function initialized with higher probabilities assigned to particular values of an aircraft performance parameter and an updating process to estimate and refine the aircraft performance parameter of the aircraft, and wherein the trajectory prediction information comprises a relative location of the at least one trajectory change point of the aircraft and the aircraft performance parameters comprise takeoff weight of the aircraft inferred from the relative location of the at least one trajectory change point, and the at least one trajectory change comprises at least one of the top of climb or top of descent.

2. The method of claim 1, wherein the trajectory prediction information regarding the aircraft is transmitted from the aircraft.

3. The method of claim 2, wherein the receiving step comprises the use of a communication link between the aircraft and the ground automation system.

4. The method of claim 1, the method further comprising applying the aircraft performance parameters to one or more trajectory predictors of the ground automation system to predict a trajectory of the aircraft.

5. The method of claim 1, wherein the using step comprises estimating at least one of the aircraft performance parameters of the aircraft by comparing the trajectory prediction information of the aircraft to a set of aircraft performance information that was generated with a trajectory predictor by varying the aircraft performance parameters of the aircraft over likely values, and then updating the at least one aircraft performance parameter based on the comparison.

6. The method of claim 1, wherein the using step further comprises using surveillance and measured data of the aircraft to infer the aircraft performance parameters of the aircraft.

7. The method of claim 1, further comprising:

initializing the aircraft performance parameters by representing each aircraft performance parameter by a probability density function.

* * * * *